United States Patent [19]

Younts, Jr.

[11] 4,198,794

[45] Apr. 22, 1980

[54] METHOD AND APPARATUS FOR DRAINING A BUILDING STRUCTURE

[76] Inventor: Lester M. Younts, Jr., 1538 N. Cove Blvd., Toledo, Ohio 43606

[21] Appl. No.: 936,218

[22] Filed: Aug. 24, 1978

[51] Int. Cl.[2] ..... E04B 1/70; E04F 17/00

[52] U.S. Cl. ..... 52/169.5

[58] Field of Search ..... 52/169.5, 287, 302, 52/303; 137/362

[56] References Cited

U.S. PATENT DOCUMENTS

| | | | |
|---|---|---|---|
| 1,734,777 | 11/1929 | Pike | 52/302 |
| 2,703,002 | 3/1955 | Suskind | 52/302 |
| 2,948,993 | 8/1960 | Marchi | 52/302 |
| 3,283,460 | 2/1967 | Patrick | 52/169.5 |
| 3,304,672 | 2/1967 | Bakke | 52/287 |
| 3,344,569 | 10/1967 | Cotten | 52/303 |
| 3,668,829 | 6/1972 | Nelson | 52/169.5 |
| 3,852,925 | 12/1974 | Gazzo | 52/169.5 |
| 3,975,467 | 8/1976 | Beck | 52/303 |
| 3,990,469 | 11/1976 | Ralston | 52/287 |
| 4,075,800 | 2/1978 | Molick | 52/169.5 |

*Primary Examiner*—John E. Murtagh

*Attorney, Agent, or Firm*—Wilson, Fraser, Barker & Clemens

[57] ABSTRACT

A dam member is positioned adjacent the junction of an upstanding wall and a floor in a building structure. The dam member is trapezoidal in cross-section with a base surface attached to the floor with sealant means and an inner side surface facing the wall and tapered away from the wall from the base surface to a parallel top surface. A cap member is removably positioned between the wall and the dam member inner surface and is spaced above the floor to define an enclosed channel with the dam member, the wall and the floor. The cap member is trapezoidal in cross-section with an outer side surface tapering away from the wall from a bottom surface to a parallel top surface, the cap member outer side surface cooperating with the dam member inner side surface to enclose the channel. A plurality of dam members and cap members are positioned end-to-end about the periphery of the floor to direct water leaking through the wall-floor junction to a central drain for removal from the building.

11 Claims, 3 Drawing Figures

METHOD AND APPARATUS FOR DRAINING A BUILDING STRUCTURE

BACKGROUND OF THE INVENTION

1. Field of the Invention

The present invention relates generally to drainage systems and in particular to a drainage system for use in the basement of a building structure.

2. Description of the Prior Art

A typical basement structure includes an upstanding wall supported on a footing and a floor having an end supported on the footing adjacent the wall. A high water table generates hydrostatic pressure which tends to force water through the walls and the wall-floor-footing junctions into the basement. A number of structures have been developed in response to this problem.

One such prior art structure was designed to eliminate water seepage by forming a plurality of longitudinally spaced apertures in at least one of the basement walls at the level of the floor and connecting the apertures with a primary fluid conduit formed from a flexible, resilient material. One end of the primary fluid conduit was connected to a floor drain and a plurality of branch conduits were positioned within the apertures and extended into the subsoil exterior of the wall to relieve the hydrostatic pressure. This structure did not, however, solve the problem of water which was forced through the wall-footing and floor-footing junctions.

In another prior art structure, a plurality of elongated drainage members were connected end-to-end about the periphery of the basement floor. Each drainage member had a base sealingly connected to the floor and an upstanding wall spaced from the basement wall. Walter collected in the area formed by the drainage members and the basement wall was directed to an aperture adjacent a drain in the basement floor. A problem with this type of structure was that it was difficult to completely drain all of the water from the drainage members such that this stagnant water tended to maintain a damp environment in the basement and collect airborne dirt and dust.

SUMMARY OF THE INVENTION

The present invention concerns a drainage system and method for draining a building structure such as a basement which has generally upstanding walls supported by a footing which also supports the periphery of the basement floor. The drainage system includes a plurality of dam members positioned adjacent the junction of the wall and the floor but spaced from the wall and a plurality of cap members removably positioned between the wall and the dam members. Each dam member is typically trapezoidal in cross-section with a base surface attached to the floor with a sealant material and an inner side surface facing the wall and tapered away from the wall from the base surface to a parallel top surface of the dam member. Each cap member is also typically trapezoidal in cross-section with an outer side surface tapering away from the wall from a bottom surface to a parallel top surface, the outer side surface cooperating with the dam member inner side surface. The cap member is spaced above the floor to define an enclosed drainage channel with the dam member, the wall and the floor.

The dam members and the cap members are positioned end-to-end about the periphery of the floor to form a drainage system which captures water leaking into the basement through the wall-floor junction. The drainage system is connected to a central drain for removal of the water from the basement.

It is an object of the present invention to decrease the expense of manufacturing and installing a drainage system for a building structure.

It is another object of the present invention to increase the accessibility to a drainage system for the purposes of repair.

It is a further object of the present invention to eliminate the need to flush and clean basement drainage systems.

DESCRIPTION OF THE PREFERRED EMBODIMENT

Figure 1:
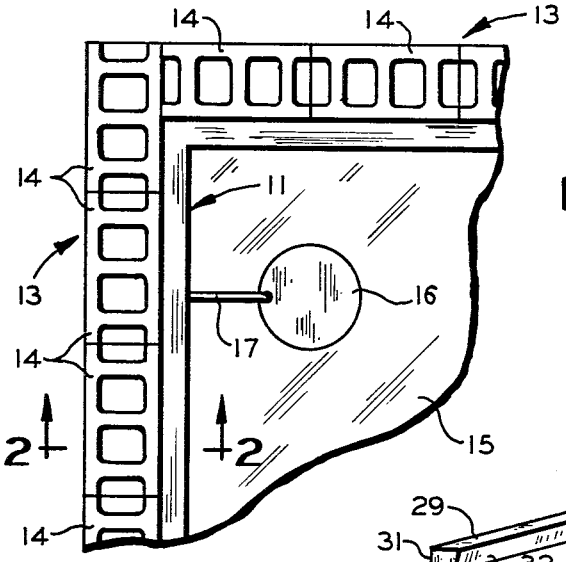
FIG. 1 is a plan view of a portion of a basement with a drainage system according to the present invention installed therein.
Figure 3:
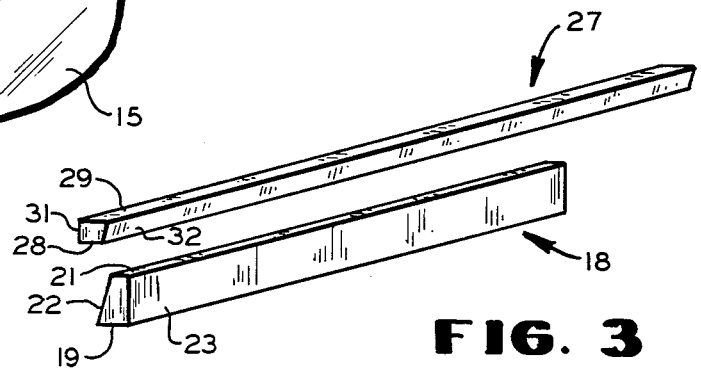
FIG 3 is a perspective view of a dam member and a cap member utilized in the drainage system shown in FIGS. 1 and 2.
Figure 2:
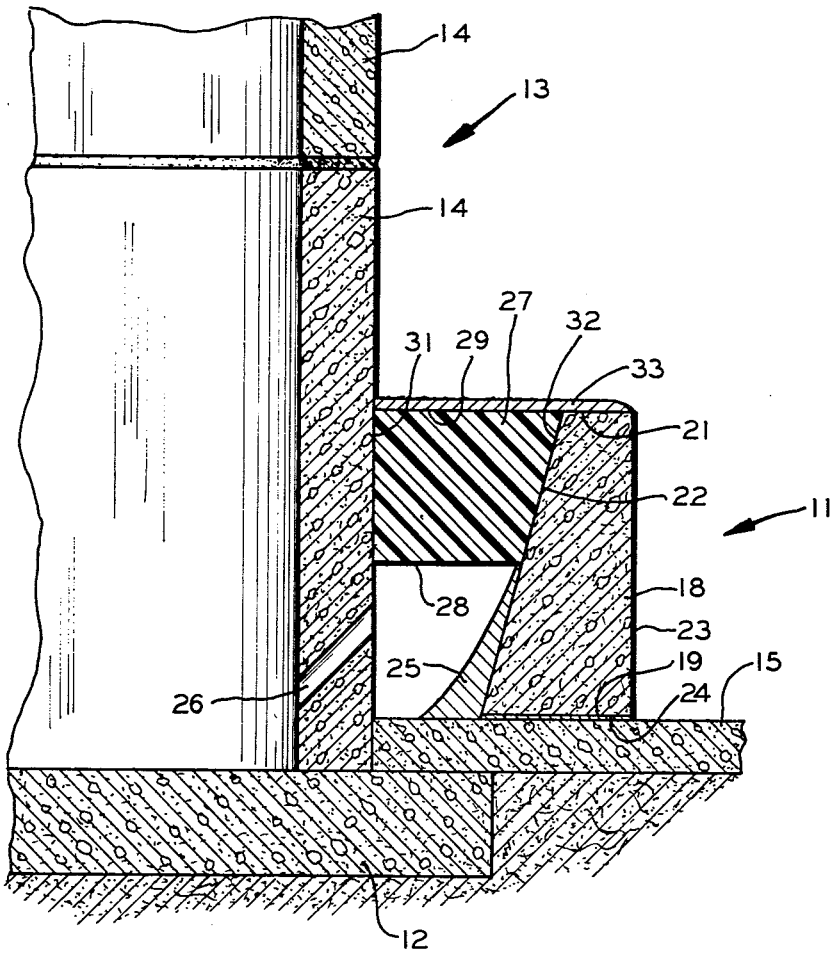
FIG. 2 is a cross-sectional view taken along the line 2—2 in FIG. 1.

There is shown in FIG. 1 a portion of a basement having a drainage system 11 according to the present invention installed therein. There is shown in FIG. 2 a cross-sectional view of the basement and the drainage system taken along the line 2—2 in FIG. 1. Typically, the basement is erected with a footing 12 supporting the basement walls 13. The walls 13 can be formed of stacked rows of conventional concrete blocks 14 joined by motar. A basement floor 15 is formed of poured concrete and is supported about its periphery by the footing 12. There can be formed in one corner of the basement floor 15 a hole or sump 16 from which excess water is drained by a sump pump (not shown) or the like. In some instances, the basement floor may simply have a drain leading to a sewer. Water leaking into the basement through the wall-floor junction is retained by the drainage system 11 and directed to an outlet tube 17 which is open to the sump 16.

The drainage system 11 includes a plurality of elongated dam members 18 which are substantially trapezoidal in cross-section. Each dam member 18 has a base surface 19 and a top surface 21 which are substantially parallel, an inner surface 22 which tapers toward an outer surface 23 from the base surface 19 to the top surface 21. The dam members 18 are positioned in end-to-end relationship about the periphery of the floor 15 adjacent to but spaced from the wall 13 as best shown in FIG. 2. An adhesive 24 can be utilized to temporarily adhere the dam members 18 to the floor 15 while the drainage system is being installed.

Next, a sealant material 25 is spread along the inner side surface 22 of each dam member 18 and the upper surface of the floor 15 in the area where the dam member and the floor meet. The sealant material 25 permanently attaches the dam members 18 to the floor 15 and prevents water from leaking through the dam member-floor junction. Care must be taken not to spread any of the sealant material 25 on the wall-floor junction so as not to block the leakage of water into the drainage system 11.

Where the basement wall 13 is formed of hollow concrete blocks 14, water can leak into the interior of these blocks and then into the basement through cracks in the basement wall or through the wall-floor junction at the base of the wall 13 along the footing 12. A plurality of apertures 26 can be drilled in the wall 13 near the base thereof at spaced intervals to connect the interior of the blocks 14 with the channel formed between the walls 13 and the dam members 18. Thus, water trapped interiorly of the blocks 14 will flow through the apertures 26 and into the drainage system 11.

After the apertures 26 are drilled, a plurality of elongated cap members 27 are positioned in end-to-end relationship between the inner side surfaces 22 of the dam members 18 and the walls 13. Each cap member 27 is substantially trapezoidal in cross-section with a base surface 28 and a top surface 29 which are substantially parallel, an inner side surface 31 and an outer side surface 32 which tapers away from the inner side surface 31 from the base surface 28 to the top surface 29. The inner side surface 31 cooperates with the wall 13 and the outer side surface 32 cooperates with the inner side surface 22 of the dam member 18 to position the cap member 27 with the top surface 29 substantially even with the top surface 21 of the dam member 18 and the base surface 28 spaced above the floor 15 to define an enclosed channel. The top surface 21 of the dam member 18 and the top surface 29 of the cap member 27 are then coated with a sealant material 33 which seals the wall-cap member junction, the cap member-dam member junction, the junctions of the ends of adjacent cap members and the junctions of adjacent dam members. The sealant 33 should be a material which can be removed easily to release the cap member 27 for access to the channel. A typical sealant material is a latex cement.

In the preferred embodiment, the dam members are preformed from concrete in approximately three foot lengths. Typically, the base surface 19 is two inches wide, the top surface 21 is one inch wide and the outer side surface 23 is four inches tall and formed at approximately right angles to the base and top surfaces.

The cap members 27 are formed from Styrofoam in approximately four foot lengths. Typically, the base surface 28 is two inches wide, the top surface 29 is two and one-half inches wide and the inner side surface 31 is two inches tall and formed at approximately right angles to the base and top surfaces. Each dam member 18 is then positioned with the outer side surface 23 approximately three and one-half inches from the wall 13 and, when the cap member 27 is positioned between the dam member 18 and the wall 13, the base surface 28 is approximately two inches above the floor 15.

In summary, the present invention concerns a drainage system and method for channeling water from a building structure such as a basement. The basement typically has an upstanding wall supported on a footing and a floor having the periphery supported on the footing in contact with the wall. The system includes an elongated dam member positioned adjacent the wall and having a base surface connected to the floor and a tapered inner side surface facing the wall. The system also includes an elongated cap member removably positioned between the dam member inner surface and the wall and spaced above the floor to define an enclosed channel with the dam member, the floor and the wall whereby water leaking through the wall-floor junction is retained in the channel for removal from the basement. A sealant material is applied to the inner side surface of the dam member and the floor to seal the floor-dam member junction against the leakage of water.

In accordance with the provisions of the patent statutes, the principle and mode of operation of the invention have been explained and illustrated in its preferred embodiment. However, it must be understood that the invention may be practiced otherwise than as specifically illustrated and described without departing from its spirit or scope.

What is claimed is:

1. A drainage system for a building structure, the structure having a footing, at least one upstanding wall supported on the footing and a floor having at least a portion of the periphery thereof supported on the footing at a junction with the wall, the system comprising:

an elongated dam member positioned adjacent to and spaced from the wall and having a base surface attached to the floor, an opposed top surface and an inner side surface facing the wall;

an elongated cap member having a top surface and being removably positioned between said dam member inner side surface and the wall and spaced above the floor to define an enclosed channel with said dam member, the floor and the wall whereby water leaking through the wall-floor junction is retained in said channel; and a sealant material covering said dam member top surface and said cap member top surface to seal the wall-cap member junction and the cap member-dam member junction against leakage of water from said channel.

2. A drainage system according to claim 1 wherein said dam member is formed of concrete and said cap member is formed of Styrofoam.

3. A drainage system according to claim 1 wherein said dam member is trapezoidal in cross-section having said top surface formed substantially parallel to said base surface and an outer side surface formed approximately at right angles to said top and base surfaces, said inner side surface tapering toward said outer side surface from said base surface to said top surface.

4. A drainage system according to claim 3 wherein said cap member is trapezoidal in cross-section having a base surface, said top surface formed substantially parallel to said base surface, an inner side surface formed approximately at right angles to said top and base surfaces and an outer side surface tapering away from said inner side surface from said base surface to said top surface.

5. A water drainage system for a building structure, the structure having a footing, a floor having the periphery thereof supported on the footing and a plurality of upstanding walls supported on the footing at a junction with the edges of the floor, the system comprising:

a plurality of elongated dam members connected end-to-end and positioned adjacent to and spaced from the walls to form a channel with the floor and the walls, each of said dam members having a base surface attached to the floor and an inner side surface facing an adjacent one of the walls;

a plurality of elongated cap members removably positioned between said dam member inner side surfaces and the walls and spaced above the floor to enclose said channel whereby water leaking through the wall-floor junction is retained in said channel; and wherein said dam members and said cap members each have a top surface, said top surfaces being substantially coplanar, and the system includes a sealant material covering said top surfaces to seal the junction of said dam member top surfaces with said cap member top surfaces and the junction of said cap member top surfaces with the walls.

6. A drainage system according to claim 5 including means for draining water retained in said channel to a point exterior of the building structure.

7. A drainage system according to claim 5 wherein at least one of the walls is formed of hollow building blocks and a plurality of apertures are formed in selected ones of said hollow building blocks to connect the interior of said blocks with said channel whereby water trapped in said blocks drains into said channel.

8. A drainage system according to claim 5 including sealant means applied to said dam member inner side surfaces and the floor adjacent thereto to seal the junction of the dam member inner side surfaces and the floor against the leakage of water from said channel.

9. A drainage system according to claim 5 wherein said dam members are trapezoidal in cross-section each having said top surface substantially parallel to said base surface and an outer side surface formed approximately at right angles to said top and base surfaces, said inner side surface tapering toward said outer side surface from said base surface to said top surface, and wherein said cap members are trapezoidal in cross-section each having a base surface, a said top surface substantially parallel to said base surface, an inner side surface formed approximately at right angles to said top and base surfaces and an outer side surface tapering away from said inner side surface from said base surface to said top surface, said dam member inner side surfaces cooperating with said cap member outer side surfaces and said cap member inner side surfaces cooperating with the walls to enclose said channel.

10. A method of draining water from a building structure having a footing, a floor having the periphery thereof supported on the footing and a plurality of upstanding walls supported on the footing at a junction with the edges of the floor, the method comprising the steps of:

a. positioning a plurality of elongated dam members connected end-to-end adjacent to and spaced from the walls to form a channel with the floor and the walls, each of said dam members having a base surface attached to the floor, a top surface and an inner side surface facing an adjacent one of the walls;

b. sealing the junction of said dam member inner side surfaces with the floor against the leakage of water from said channel;

c. positioning a plurality of removable cap members between the dam member inner side surfaces and the walls and spaced above the floor to enclose said channel, each of said cap members having a top surface substantially coplanar with said top surfaces of said dam members; and d. applying a sealant material to said top surfaces to seal the junction of said dam member top surfaces with said cap member top surfaces and the junction of said cap member top surfaces with the walls.

11. A method according to claim 10 wherein at least one of the walls is formed of hollow building blocks and including the step of forming apertures in said blocks to connect the interior of said blocks with said channel whereby water trapped in said blocks drains into said channel, said forming step being performed before step c.

* * * * *